US009028389B2

(12) United States Patent
Dworatzek et al.

(10) Patent No.: US 9,028,389 B2
(45) Date of Patent: May 12, 2015

(54) CENTRIFUGAL SEPARATOR WITH SNAP FIT SEPARATION CONE

(75) Inventors: Klemens Dworatzek, Edingen (DE); John Lawrence Mills, Ilminster (GB); Nigel Burford, Taunton (GB); Anthony W. Fell, Yeovil (GB); Nicholas Foulkes, Chard (GB)

(73) Assignee: Mann+Hummel GmbH, Ludwigsburg (DE)

( * ) Notice: Subject to any disclaimer, the term of this patent is extended or adjusted under 35 U.S.C. 154(b) by 1099 days.

(21) Appl. No.: 13/023,867

(22) Filed: Feb. 9, 2011

(65) Prior Publication Data

US 2011/0201488 A1 Aug. 18, 2011

(30) Foreign Application Priority Data

Feb. 15, 2010 (GB) ..... 1002526.0

(51) Int. Cl.

| | |
|---|---|
| ***B04B 9/06*** | (2006.01) |
| ***B04B 5/00*** | (2006.01) |
| ***B04B 7/08*** | (2006.01) |
| *F01M 13/04* | (2006.01) |

(52) U.S. Cl.

CPC . *B04B 5/005* (2013.01); *B04B 7/08* (2013.01); *F01M 2013/0422* (2013.01)

(58) Field of Classification Search

CPC ..... B04B 9/06

USPC ..... 494/49, 64

See application file for complete search history.

(56) References Cited

U.S. PATENT DOCUMENTS

| | | | | |
|---|---|---|---|---|
| 4,798,577 | A | 1/1989 | Brenneman et al. | |
| 6,095,964 | A * | 8/2000 | Purvey | 494/49 |
| 6,224,531 | B1 * | 5/2001 | Frehland et al. | 494/49 |
| 6,234,949 | B1 * | 5/2001 | Cox et al. | 494/49 |
| 2006/0258523 | A1 * | 11/2006 | Samways et al. | 494/49 |

* cited by examiner

*Primary Examiner* — Charles Cooley
*Assistant Examiner* — Marc C Howell
(74) *Attorney, Agent, or Firm* — James Hasselbeck

(57) ABSTRACT

A separation cone (30) is mounted into the interior chamber of a centrifugal separator rotor (10), which comprises a cover (14) releasably connected to a base (16), in order to provide a frusto-conical wall subdividing the chamber into upper and lower regions. This slows the passage of fluid from the upper to the lower region, which takes place via openings (24) and/or via a gap between the inner rim (32) of the cone (30) and the axial inlet tube (12). The separation cone (30) is connected to the cover (14) by a releasable snap fit arrangement, such as by deflectable tabs (38) around the periphery of the separation cone (30) engaging into a groove (15) around the interior surface adjacent a lower edge of the cover (14). This allows there to be a predetermined sequence of servicing operations and ensures that the separation cone (30) will reliably stay with the cover (14) when the cover is removed.

8 Claims, 6 Drawing Sheets

14
10
22
24
12
38
15
39
34
39
18
35
32
38
19
36
26
30
20
16
A

CENTRIFUGAL SEPARATOR WITH SNAP FIT SEPARATION CONE

CROSS REFERENCE TO RELATED APPLICATIONS

This application claims the benefit under 35 USC 119 of foreign application 1002526.0 filed in the United Kingdom on Feb. 15, 2010, and which is hereby incorporated by reference in its entirety.

TECHNICAL FIELD

The invention relates to a self-driven, fluid powered centrifugal separator.

BACKGROUND OF THE INVENTION

Fluid powered centrifugal separators are well-known for separating fluids of different densities or for separating particulate matter from liquids and have long been used in lubrication systems for engines, particularly diesel powered vehicle engines (automobiles and ships), as well as in other industrial separation processes. The principle of operation of such a separator is that a housing contains a rotor which is supported therein to spin at high speed about a substantially vertical axis provided by a central tube. Fluid is supplied at elevated pressure along the axis of rotation and is ejected from tangentially directed nozzles in the base of the rotor into the housing from which it drains to a sump. In self-powered separators the drive fluid for the rotor is the contaminated fluid which is to be cleaned. As this fluid passes through the rotor, denser contaminant materials or particles are separated there from centrifugally and retained in the rotor, typically as a cake adhering to the interior surface of the rotor.

The rotor interior is typically divided, by means of a separation cone, into two separate, but communicating chambers, namely an upper chamber which receives the incoming fluid and the contaminant particles, and a lower chamber from which the fluid emerges via the nozzles. The separation cone provides a frusto-conical wall which inclines downwards from an upper rim in the vicinity of the central tube to a lower periphery adjacent the interior surface of the rotor. An opening is provided for passage of fluid from the upper to the lower chamber by either a gap between the inner rim of the separation cone and the central tube or, where the inner rim is mounted as a closed fit around said tube, by one or more apertures in the separation cone in the vicinity of the central tube. Fluid enters the upper chamber of the rotor through apertures in the central tube, flows firstly down the interior surface of the rotor upper chamber and then up the surface of the separation cone before passing into the lower chamber through aforesaid opening, and thence to exit via the nozzles. The separation cone is important in preventing detritus, namely contaminant particles, from falling directly into the area of the nozzles, thus minimizing risk of any blockage. It also causes a change of direction of oil flow inwardly towards the central support tube before it can pass into the lower chamber. This slows the flow and allows more time for the contaminant particles to be trapped on the inner surface of the rotor upper chamber, thus increasing separation/cleaning efficiency of the rotor.

The rotor itself is typically formed in two parts as an upper bell shaped cover and a lower base. In older arrangements, for example as disclosed in GB 2283694, these were connected together by crimping and the periphery of the separation cone was connected there between in the crimping operation. In more recent commercial versions of centrifugal separator the cover is typically threaded connected to the base and can therefore be unscrewed and screwed on again in servicing operations. In this respect, contaminant debris deposited in the interior of the upper chamber, most adhering to the interior wall, but some not well adhered or lying free within the chamber, needs to be periodically removed. This may be done, for example, once or twice a year during vehicle servicing in the case of centrifugal separators in automotive vehicles, or may be done much more frequently in other industrial uses of centrifugal separators of this self driven type.

The separation cone may be mounted by its upper rim fitting onto the central tube or by friction fit inside the rotor. When the cover is separated from the base of the rotor for servicing purposes, namely cleaning out of the separator, the separation cone may stay with the cover or it may stay with the base. There is no consistency, and no possibility of a predetermined sequence of servicing operations. There is always a servicing operation, cleaning out the cover interior. Also, there is a possibility that the risk that the separation cone will not stay with the cover when the cover is removed and that debris will drop out of the cover, either into the base which could be detrimental in later blocking a nozzle, or nearby, causing mess and contamination and delay in what is already a dirty and messy part of the separation cone will be glued by dirt to the interior of the cover, making one or both difficult to remove in disassembly of the rotor, and again risking spillage and contamination of the servicing area. If a tool has to be used in order to separate the cone, there is additionally the risk of damage to the parts which may prevent reassembly to a fully efficient rotor condition. In this respect, it is most important that particulate matter debris is not allowed to pass into the base, namely that there is no gap allowing this between the periphery of the separation cone and the interior surface of the rotor. It is equally important that the symmetrical balance of the rotor is maintained upon reassembly following servicing in order to retain efficient centrifugal separation and maintain the effective life of the rotor, namely minimize vibration and wear which can occur through imbalance in operational conditions.

It is therefore an objective of the present invention is to disclose a centrifugal separator that avoids the above-mentioned problems of existing centrifugal separator design.

SUMMARY OF THE INVENTION

In accordance with the present invention there is provided a self-driven centrifugal separator for removal of particulate matter from fluid, the separator comprising a substantially cylindrical vessel for rotatably mounting on to a central inlet tube, the vessel having a base provided with outlet nozzles, an upper cover connected to the base to define an internal chamber, and a separation cone mounted in the chamber and providing a frusto-conical wall subdividing the chamber into upper and lower regions, the separation cone having an inner rim in the vicinity of the inlet tube and an opening at or adjacent said inner rim to allow fluid to pass from the upper to the lower region of the chamber in use of the separator, characterized in that the separation cone is connected to the cover by a releasable snap fit arrangement.

The separation cone is, of course, connected non-rotatably to the cover, namely for rotation in unison with the cover in operation of the centrifugal separator. The advantage of the cone to cover connection is that the cone will then reliably stay with the cover when the cover is lifted away from the base during disassembly for servicing, specifically cleaning out of the separator. Separation of the cone from the cover can then take place away from the base, avoiding any risk of debris falling into the base. The separation of the cone from the cover May be facilitated by using the central opening of the cone as a handle.

A suitable manner in which to provide the releasable snap fit connection is to provide the periphery of the separation cone with deflectable tabs. In this respect, the periphery of the separation cone typically has an upstanding flange and the deflectable tabs are suitably provided on this upstanding flange. For reliability of connection, the cover is preferably provided with a groove in its interior surface, adjacent a lower edge of the cover and the aforesaid deflectable tabs then provide the releasable snap fit connection by engaging with this groove.

Again, for reliability of the connection to be achieved, the deflectable tabs are preferably provided with projections, such as outwardly directed, wedge-shaped projections, for engagement into the groove in the cover. In some embodiments it may be advantageous for such projections to have an axial extent less than the width of the groove so that the projection cone can be moved axially relative to the cover within the width of the groove. Such axial movement may be accomplished only by manipulation of the separation cone, for example by grasping the central opening of the cone, as mentioned above, after the cover has been removed from the base of the separator and may facilitate introduction of a tool to separate the cone from the cover. Such manner of disengagement has less risk of damage to the cone or the cover than in the prior art. Moreover, the upstanding flange of the separation cone may, for the same purpose, be provided with at least one edge adjacent notch or recess to facilitate insertion of a tool to prize off the separation cone.

A particularly favorable development of the present invention is to provide the separation cone and the cover with respective inter-engaging locator formations which enable the cone to be fitted to the cover in a predetermined rotational position. In this respect, maintaining the correct symmetrical balance of the separator is important to efficient operation of the centrifuge and to achieving optimum life of the separator. In prior art arrangements, after servicing, the separation cone might be replaced in any rotational position, whereas with this development reattachment is possible only in the predetermined optimal position of the separation cone. The locator formations may, for example, comprise at least one projecting lug on the separation cone and a corresponding at least one recess or notch in the cover for reception of said lug or lugs.

A further independent aspect of the invention is a separation cone alone, the cone being, of course, for a self-driven centrifugal separator, and having an upstanding flange and deflectable tabs provided on this upstanding flange to enable releasable snap fit connection of the cone into a lower region of the cover of the separator.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
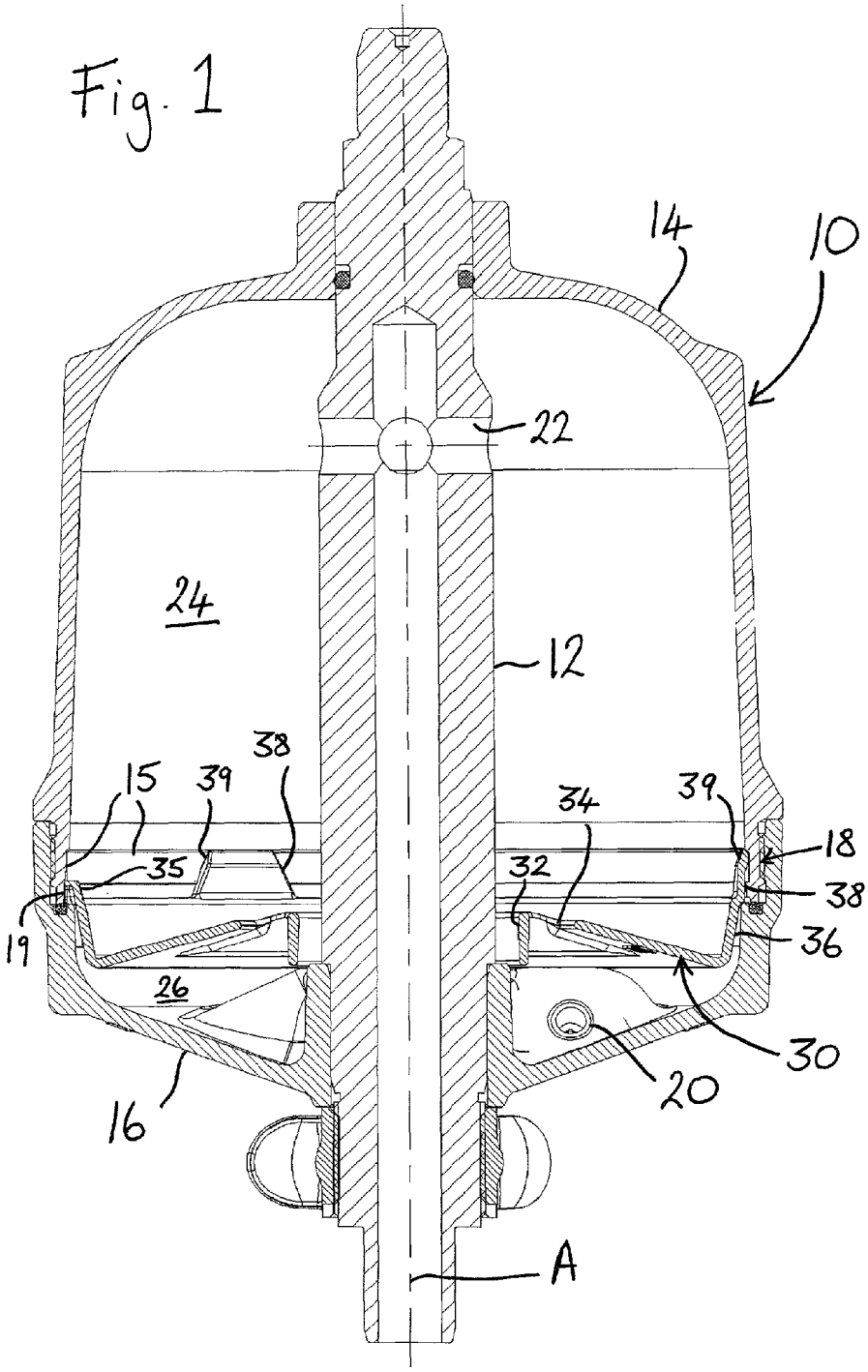
FIG. 1 is a longitudinal cross-section of a preferred practical embodiment of a centrifugal separator in accordance with the invention mounted onto a central inlet tube in the form of a hollow spindle.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to centrifugal separator. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As shown in the drawings, a preferred practical example of the centrifugal separator of the invention comprises a substantially cylindrical vessel which constitutes a rotor 10, which in use is mounted onto a hollow tube or spindle 12, which provides the axis A about which the rotor 10 spins during operation. The rotor 10 comprises a bell shaped cover 14 mounted onto a base 16 by threaded inter-engagement at 18. Respective tangentially directed nozzles 20 are provided in the base 16. As already described in the introduction, and as is well-known in the art, the separator operates by having fluid, such as oil in a lubrication system of the vehicle, supplied at elevated pressure along the axis A of the spindle 12, exiting via apertures 22 into the interior of the rotor 10. The outflow of fluid from the nozzles 20 in the base 16 serves to drive the rotor and the centrifugal action caused thereby serves to deposit contaminant particles within the fluid on the interior surface of the cover 14.

Figure 6:
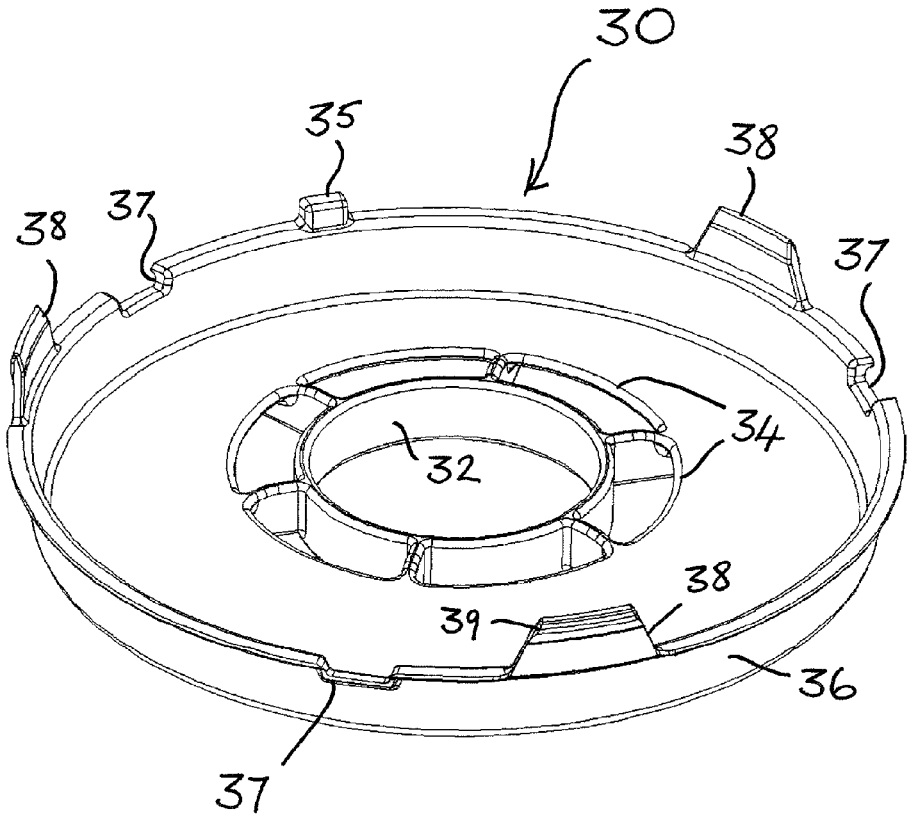
FIG. 6 is an enlarged perspective view of the separation cone alone, in accordance with a further aspect of the invention.

A separation cone 30, which is shown separately in FIG. 6, is mounted inside the rotor 10 and divides the internal chamber into an upper chamber 24 and a lower chamber 26. The separation cone 30 provides a frusto-conical wall which inclines downwards from a rim 32 in the vicinity of the spindle 12 to a lower edge adjacent the internal surface of the rotor 10. A gap remains between the inner rim 32 and the spindle 12, as is evident in FIGS. 1, 2 and 3. Additionally, a series of openings 34 are provided adjacent the rim 32. The aforesaid gap and the openings 34 allow for passage of fluid from the upper chamber 24 to the lower chamber 26.

At its outer periphery, the separation cone 30 is provided with an upstanding flange 36 and further upstanding from this flange are deflectable tabs 38, three being shown at equally spaced intervals in the illustrated embodiment, particularly FIG. 6. These tabs 38 each have an outwardly projecting upper edge margin 39, and it is these projections 39 which make a snap fit connection with the interior of the cover 14.

The cover 14 is formed with a circumferential groove 15 at a short spacing from its open lower end. The axial extent of this groove 15 is greater than the size of the projections 39, which allows for axial displacement of the separation cone 30 relative to the cover 14, as will be explained.

In addition to the three upstanding tabs 38, the edge of the upstanding flange 36 of the cone 30 is also provided with three equally spaced recesses 37 in its upper edge, again as best shown in FIG. 6. The purpose of these recesses 37 is to allow insertion of a tool into any selected one of them for quick and easy disengagement of the cone 30 from the cover 14.

Also provided on the edge of the upstanding flange 36 of the cone 30 is a locator lug 35. In order to fit the cone 30 into the lower end of the cover 14 in the manner shown in FIGS. 1 to 4 this locator lug 35 has to fit into a matching recess 19 in the inner surface of the cover 14 in the vicinity of the groove 15. It will be obvious to a fitter when this engagement of the lug 35 into its matching recess 19 has taken place, as in this position the cone 30 will no longer be rotatable relative to the cover 14. The inter-engagement of the lug 35 and the matching recess 19 then defines the optimal rotational position of the cone 30 relative to the cover 14, with consequent advantages for efficiency of operation and long-term minimizing of wear, as already discussed. Suitable marking may be provided on the outside of the cover 14 to indicate to a fitter the position of the recess to which the locator lug 35 needs to be fitted when the cone 30 is being offered up for connection to the underside of the cover 14.

Figure 2:
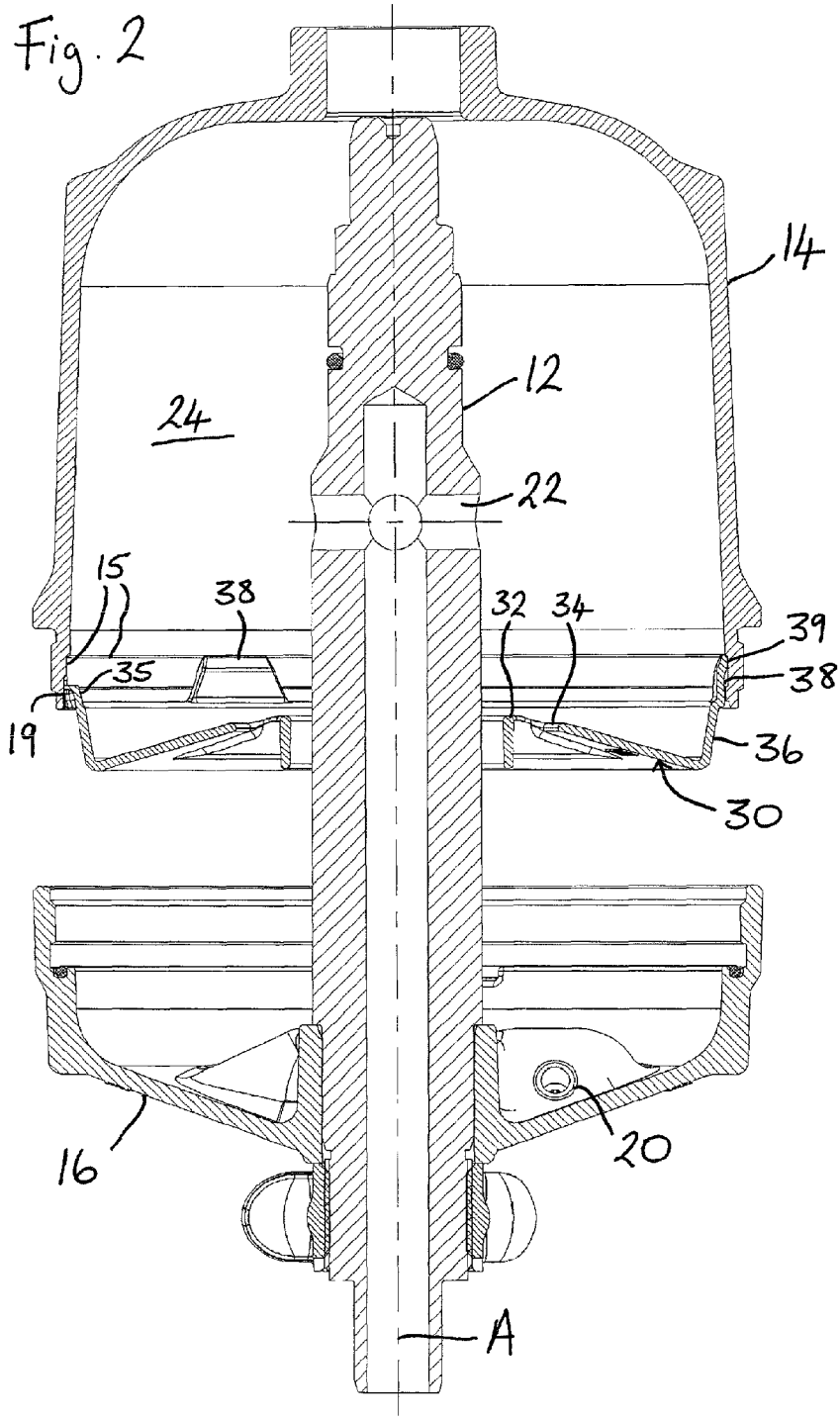
FIG. 2 is a corresponding view, to a slightly reduced scale, of the first stage in disassembly of the separator shown in FIG. 1, in which the cover has been unscrewed and lifted from the base of the separator.
Figure 3:
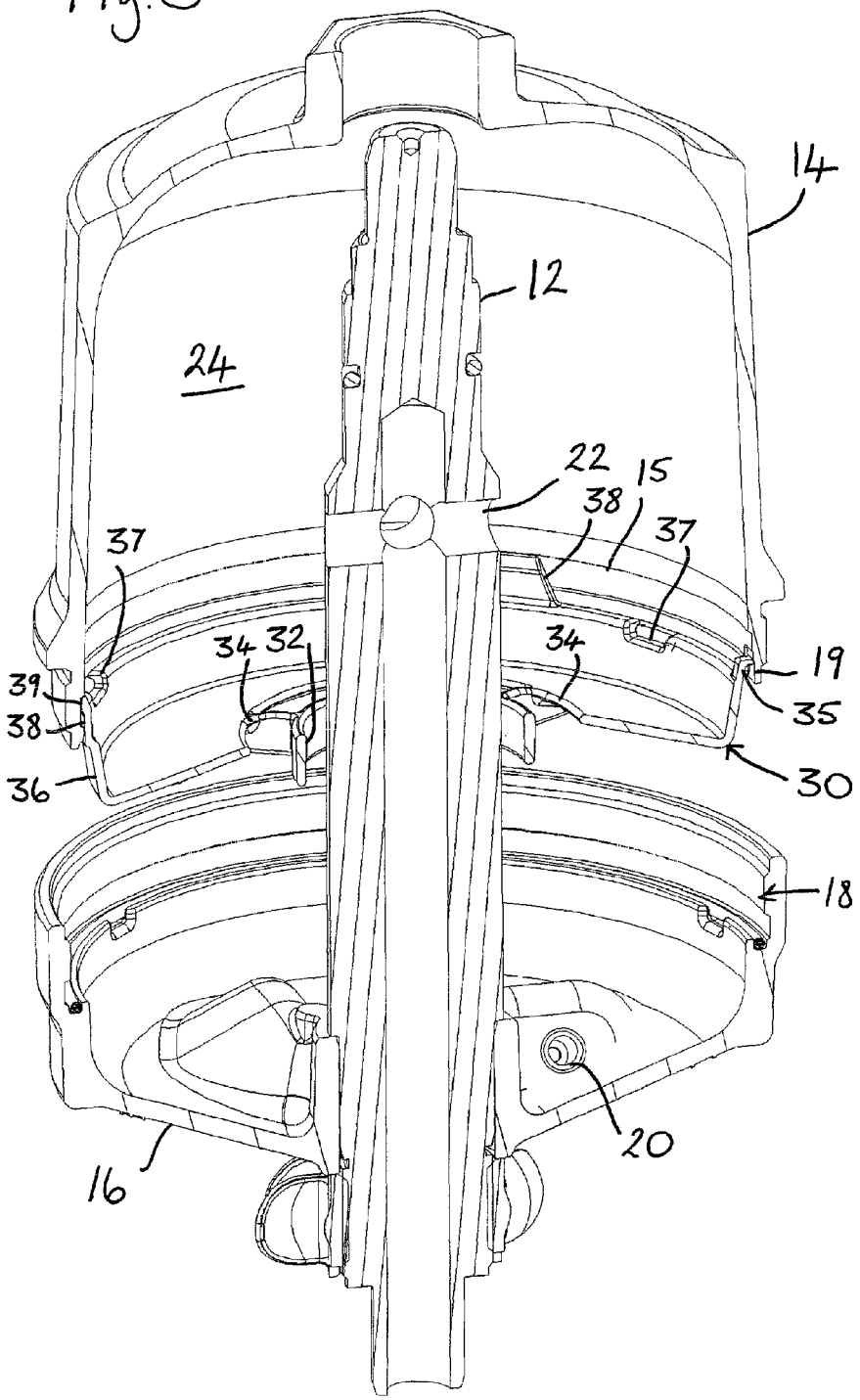
FIG. 3 is a perspective view, still partially cross-sectional, showing the first stage of disassembly as in FIG. 2, but viewed at a different rotational location of the separator.

Starting from the fully assembled and operational condition illustrated in FIG. 1, where the rotor 10 is mounted onto the spindle 12, the sequence of disassembly of the centrifugal separator for purposes of servicing, namely cleaning out the interior of the cover 14, are illustrated in FIGS. 2 to 5. Firstly, the cover 14 is unscrewed from the base 16 at the threaded connection 18. The cover 14 can then be lifted off, as shown in FIGS. 2 and 3. In this respect, of course, the separation cone 30, which has its tabs 38 snap fit engaged into the groove 15 of the cover 14, remains reliably with the cover 14.

Figure 4:
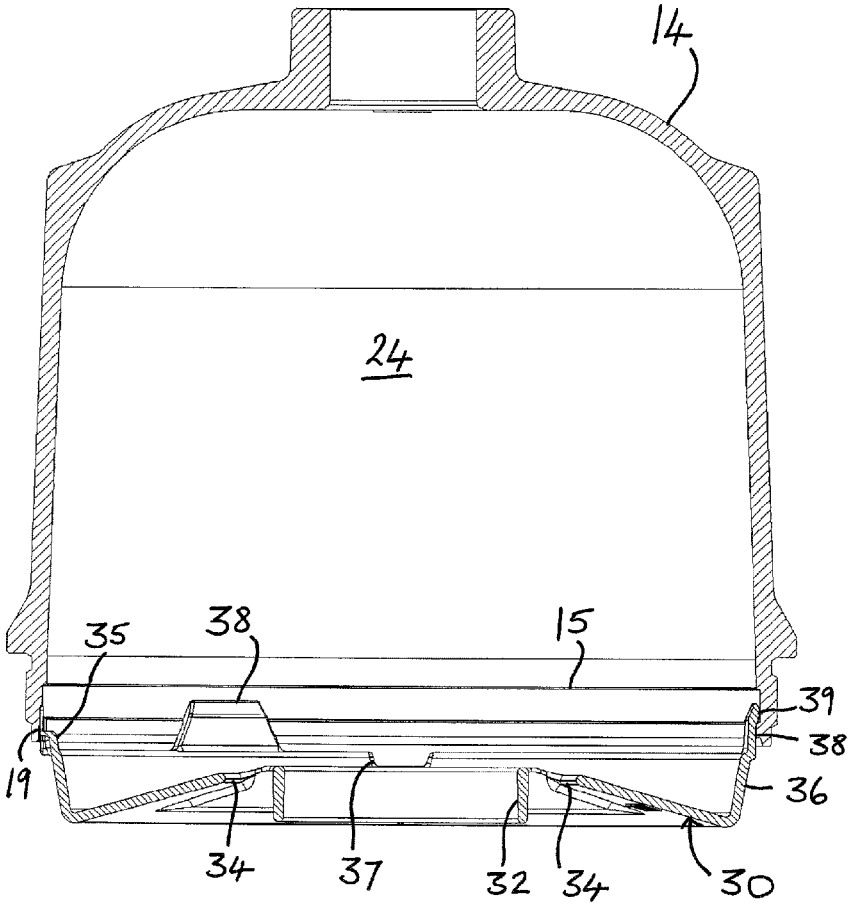
FIG. 4 is a longitudinal cross-section showing the second stage in disassembly of the separator shown in the preceding figures, namely the cover and separation cone on their own after having been lifted away from the central inlet tube, and with the cone displaced downwards.
Figure 5:
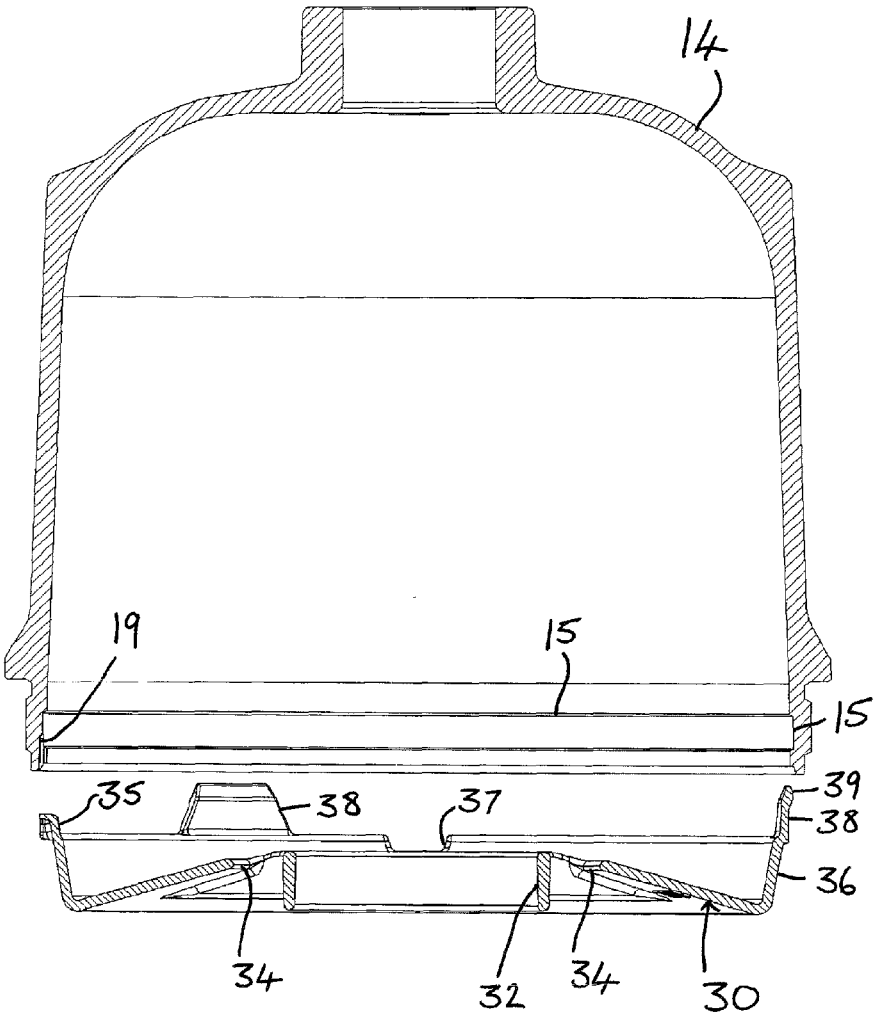
FIG. 5 is a longitudinal cross-section showing the third stage in disassembly of the separator, namely the separation cone having now been separated from the cover.

Once the cover/separation cone combination 14, 30 has been lifted off, an operative may grasp the separation cone 30 by means of the central opening defined by the rim 32 and pull it downwards, by application of moderate downward force, so that the engaging tabs 38 are displaced downwards within the wider groove 15 of the cover 14 to the position shown in FIG. 4. This brings the respective recesses 37 below the level of the lower edge of the cover 14, as is evident in FIG. 4. A tool such as a screwdriver can then be inserted into one of these recesses 37 in order to prize off the separation cone 30, namely release the tabs 38, specifically the outwardly projecting upper edges 39 of same, From their snap fit connection. The cover 14 and cone 30 after separation are shown in FIG. 5, and in the overall structure of this embodiment of cone is more clearly apparent in FIG. 6.

Reassembly is by the reverse sequence of operations. Generally, the inside of the cover 14, and perhaps the upper surface of the cone 30, will have been cleared of debris before reassembly. This cleaning out will preferably take place at a location away from the base and is facilitated by the cone 30 being reliably lifted off in combination with the cover 30, as in FIG. 4, because of the snap fit connection of the cone 32 the cover 14. Thus, in this reverse re-assembly operation the cone 30 is firstly reconnected to the cover 14, care being taken that the lug 35 engages into its matching recess so that the tabs 38 readily make their snap fit connection into the groove 15. The cover 14, with the fitted cone 30, is then lifted back onto the spindle and screwed back onto the base 16.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A self-driven centrifugal separator for removal of particulate matter from fluid, the separator comprising:

an elongated central inlet tube having an axis;

a substantially cylindrical vessel rotatably mounted onto said central inlet tube to rotate about said axis, said vessel including a base provided with fluid outlet nozzles discharging fluid into in interior of said vessel;

an upper cover detachably secured to said base, said cover and base defining an internal chamber of said vessel; and a separation cone mounted in said chamber of said vessel, said separation cone including a frusto-conical wall subdividing said chamber into an upper region and a lower region;

an inner rim arranged in the vicinity of said central inlet tube;

an opening in said separator cone arranged at or adjacent to said inner rim, said opening passing fluid from said upper region to said lower region of the chamber during use of said separator; and a periphery portion of said separator cone which is lower than said inner rim and in contact with an interior surface of said vessel;

wherein said separation cone is connected to the cover by a releasable snap fit mounting arrangement, wherein said periphery portion of said separation cone includes deflectable tabs, and wherein said deflectable tabs engaged an interior wall of said vessel providing said releasable snap fit mounting, wherein said deflectable tabs include outwardly directed projections, wherein said projections have an axially arranged extent less than an axial width of said groove so that said separator cone can be moved axially relative to said cover within said width of said groove.

2. The separator according to claim 1, wherein said periphery portion of said separation cone includes an upstanding flange, and wherein said deflectable tabs are provided on said upstanding flange.

3. The separator according to claim 1 wherein said cover includes a groove on its interior surface, said groove arranged adjacent to a lower edge of said cover, and wherein said deflectable tabs engage into said groove providing said releasable snap fit mounting.

4. The separator according to claim 1, wherein said separation cone and said cover include respective inter-engaging locator formations configured to enforce fitting of said cone into said cover at a predetermined fixed rotational position, preventing rotation of said separator cone within said cover.

5. The separator according to claim 4 wherein said separation cone includes at least one projecting lug, and wherein said cover includes a corresponding at least one recess or notch configured to receive and engage said at least one projecting lug.

6. A separation cone for the self-driven centrifugal separator of claim 5, said separator cone comprising:

the frusto-conical wall subdividing said chamber into the upper region and the lower region;

the inner rim arranged in the vicinity of the central inlet tube of said separator;

the opening in said separator cone arranged at or adjacent to said inner rim, said opening passing fluid from said upper region to said lower region of the chamber during use of said separator; and the periphery portion of said separator cone which is lower than said inner rim and in contact with an interior surface of said vessel, wherein said separation cone is connected to the cover by the releasable snap fit mounting arrangement, wherein said periphery portion of said separation cone includes the deflectable tabs, said deflectable tabs engaging an interior of said vessel providing said releasable snap fit mounting, an upstanding flange arranged on said periphery portion of said separation cone, wherein said deflectable tabs enable a releasable snap fit mounting of said cone into a lower region of a cover of said separator, wherein said separation cone and said cover include respective inter-engaging locator formations configured to enforce fitting of said cone into said cover at a predetermined fixed rotational position, preventing rotation of said separator cone within said cover;

wherein said engagement of locator formations rotatably locks said separator cone to said cover such that said separator cone rotates in unison with said cover, wherein said periphery portion of said separator cone includes a frusto-conical wall inclining downwards from said inner rim, wherein said upstanding flange is arranged at an outer periphery of said periphery portion of said separator cone, wherein said deflectable tabs are arranged on said upstanding flange, wherein said upstanding flange includes recesses to facilitate disengagement of said cone from said cover, and wherein said recesses are arranged on said upstanding flange.

7. A self-driven centrifugal separator for removal of particulate matter from fluid, the separator comprising:

an elongated central inlet tube having an axis;

a substantially cylindrical vessel rotatably mounted onto said central inlet tube to rotate about said axis, said vessel including a base provided with fluid outlet nozzles discharging fluid into in interior of said vessel;

an upper cover detachably secured to said base, said cover and base defining an internal chamber of said vessel; and a separation cone mounted in said chamber of said vessel, said separation cone including a frusto-conical wall subdividing said chamber into an upper region and a lower region;

an inner rim arranged in the vicinity of said central inlet tube;

an opening in said separator cone arranged at or adjacent to said inner rim, said opening passing fluid from said upper region to said lower region of the chamber during use of said separator; and a periphery portion of said separator cone which is lower than said inner rim and in contact with an interior surface of said vessel;

wherein said separation cone is connected to the cover by a releasable snap fit mounting arrangement, wherein said periphery portion of said separation cone includes deflectable tabs, and wherein said deflectable tabs engaged an interior wall of said vessel providing said releasable snap fit mounting, wherein said periphery portion of said separation cone includes an upstanding flange, and wherein said deflectable tabs are provided on said upstanding flange, wherein said upstanding flange includes at least one notch or recess positioned adjacent to an edge of said upstanding flange to facilitate disengagement of said cone from said cover.

8. A self-driven centrifugal separator for removal of particulate matter from fluid, the separator comprising:

an elongated central inlet tube having an axis;

a substantially cylindrical vessel rotatably mounted onto said central inlet tube to rotate about said axis, said vessel including a base provided with fluid outlet nozzles discharging fluid into in interior of said vessel;

an upper cover detachably secured to said base, said cover and base defining an internal chamber of said vessel; and a separation cone mounted in said chamber of said vessel, said separation cone including a frusto-conical wall subdividing said chamber into an upper region and a lower region;

an inner rim arranged in the vicinity of said central inlet tube;

an opening in said separator cone arranged at or adjacent to said inner rim, said opening passing fluid from said upper region to said lower region of the chamber during use of said separator; and a periphery portion of said separator cone which is lower than said inner rim and in contact with an interior surface of said vessel;

wherein said separation cone is connected to the cover by a releasable snap fit mounting arrangement, wherein said periphery portion of said separation cone includes deflectable tabs, and wherein said deflectable tabs engaged an interior wall of said vessel providing said releasable snap fit mounting, wherein said periphery portion of said separation cone includes an upstanding flange, and wherein said deflectable tabs are provided on said upstanding flange, wherein said cover includes a groove on its interior surface, said groove arranged adjacent to a lower edge of said cover, wherein said deflectable tabs engage into said groove providing said releasable snap fit mounting, wherein said deflectable tabs include outwardly directed projections, wherein said projections have an axially arranged extent less than an axial width of said groove so that said separator cone can be moved axially relative to said cover within said width of said groove, wherein said upstanding flange includes at least one notch or recess positioned adjacent to an edge of said upstanding flange to facilitate disengagement of said cone from said cover, wherein said separation cone and said cover include respective inter-engaging locator formations configured to enforce fitting of said cone into said cover at a predetermined fixed rotational position, preventing rotation of said separator cone within said cover, wherein said separation cone includes at least one projecting lug, and wherein said cover includes a corresponding at least one recess or notch configured to receive and engage said at least one projecting lug.

* * * * *